US007762238B2

(12) United States Patent
Gibson et al.

(10) Patent No.: US 7,762,238 B2
(45) Date of Patent: Jul. 27, 2010

(54) SLEEVE METERED UNIT PUMP AND FUEL INJECTION SYSTEM USING THE SAME

(75) Inventors: Dennis H. Gibson, Chillicothe, IL (US); Mark F. Sommars, Sparland, IL (US)

(73) Assignee: Caterpillar Inc., Peoria, IL (US)

( * ) Notice: Subject to any disclaimer, the term of this patent is extended or adjusted under 35 U.S.C. 154(b) by 1662 days.

(21) Appl. No.: 10/214,865

(22) Filed: Aug. 7, 2002

(65) Prior Publication Data

US 2003/0019478 A1 Jan. 30, 2003

Related U.S. Application Data

(62) Division of application No. 09/549,387, filed on Apr. 14, 2000, now abandoned.

(60) Provisional application No. 60/129,699, filed on Apr. 16, 1999.

(51) Int. Cl.
*F02M 37/04* (2006.01)
*F02M 37/06* (2006.01)

(52) U.S. Cl. ..... 123/506; 123/456

(58) Field of Classification Search ..... 123/456, 123/450, 449, 458, 506, 508, 495, 499, 446; 417/221, 222.1
See application file for complete search history.

(56) References Cited

U.S. PATENT DOCUMENTS 2,393,544 A 1/1946 Lum
4,417,555 A 11/1983 Deutschmann et al.
4,478,187 A 10/1984 Yamada
4,480,619 A 11/1984 Igashira et al.
4,489,684 A * 12/1984 Yamada ..... 123/198 F
4,489,694 A 12/1984 Roca-Nierga
4,526,145 A * 7/1985 Honma et al. ..... 123/357
4,573,442 A * 3/1986 Matsumura et al. ..... 123/450
4,706,626 A 11/1987 Hafele et al.
4,977,882 A * 12/1990 Nakamura et al. ..... 123/502
5,404,855 A 4/1995 Yen et al.
5,515,829 A 5/1996 Wear et al.
5,603,609 A 2/1997 Kadlicko
5,771,864 A * 6/1998 Morishita et al. ..... 123/456
6,135,090 A * 10/2000 Kawachi et al. ..... 123/446
6,230,684 B1 * 5/2001 Furuhashi et al. ..... 123/467

FOREIGN PATENT DOCUMENTS

EP 0 307 947 A2 3/1989
EP 0 459 429 A1 12/1991
EP 0 481 964 A2 4/1992
EP 0 724 074 A2 7/1996
JP 59-119059 10/1984

* cited by examiner

*Primary Examiner*—Mahmoud Gimie
(74) *Attorney, Agent, or Firm*—Liell & McNeil

(57) ABSTRACT

Pressurized injector actuation fluid, such as oil or fuel, is supplied to high pressure common rail by a fixed displacement fluid pump. Variable delivery from the pump is achieved by an improved sleeve metering approach. The sleeve surrounds the reciprocating piston and is manipulated to control venting of pumped fluid through vent ports in the piston. The sleeve is moved by preferably being the armature of a solenoid assembly. The varying of current to the solenoid coil alters the axial position of the sleeve relative to the piston to vary the effective pumping stroke of the piston.

12 Claims, 3 Drawing Sheets

SLEEVE METERED UNIT PUMP AND FUEL INJECTION SYSTEM USING THE SAME

RELATION TO OTHER APPLICATION

This application is a division of Ser. No. 09/549,387, Filed Apr. 14, 2000 with the same title, now abandoned which claims priority to provisional application 60/129,699, filed Apr. 16, 1999 with the same title as above.

TECHNICAL FIELD

This invention relates to a sleeve metered, variable delivery fluid pump and, more particularly to a common rail fuel injection system which utilizes the pump to supply actuation fluid to a common fluid accumulator or rail.

BACKGROUND ART

In a common rail fuel injection system, high pressure actuation fluid is used to power electronic unit injectors, and the actuation fluid is supplied to the injectors from a high pressure fluid accumulator, which is referred to as a rail. To permit variation of the fluid pressure supplied to unit injectors from the rail, it is desirable to vary the delivery of fluid to the rail from one or more actuation fluid pumps. Known common rail systems typically rely on either a single fluid pump that supplies fluid to the rail or a plurality of smaller displacement pumps that each supplies fluid to the rail. The volume and rate of fluid delivery to the rail has been varied in the past by providing a rail pressure control valve that spills a portion of the delivery from a fixed delivery pump to maintain the desired rail pressure.

Variable delivery pumps are well known in the art and are typically more efficient for common rail fuel systems than a fixed delivery actuation fluid pumps, since only the volume of fluid needed to attain the desired rail pressure must be pumped. For example, variable delivery has been achieved from an axial piston pump, e.g. a pump wherein one or more pistons are reciprocated by rotation of an angled swash plate, by varying the angle of the swash plate and thus varying the displacement of the pump. In such a pump, the swash plate is referred to as a "wobble plate". Variable delivery has also been achieved in fixed displacement, axial piston pumps by a technique known as sleeve metering, in which each piston is provided with a vent port that is selectively closed by a sleeve during part of the piston stroke to vary the effective pumping portion of the piston stroke.

While known variable delivery pumps designs are suitable for many purposes, known designs are not always well suited for use with modern hydraulically actuated fuel systems, which require fluid delivery to the rail to be varied with high precision and with rapid response times measured in microseconds. In addition, known variable delivery pumps designs are typically complex, may be costly, and are subject to mechanical failure.

In one specific example, U.S. Pat. No. 5,630,609 to Kadlicko shows a fixed displacement swash plate type pump that achieves variable output via sleeve metering. The sleeve metering mechanism of Kadlicko appears to utilize a hydraulic force that is balanced against a spring force to adjust the position of the sleeve. In order to adjust the pump output, the positions of the metering sleeves are sensed and then fluid pressure is adjusted to move the sleeves to a different desired output position. The Kadlicko pump appears to suffer from several drawbacks, including its complex control strategy, which would appear to be accompanied by relatively difficult problems in calibrating control signals with desired outputs from the pump.

This invention is directed to overcoming one or more of the problems described above.

DISCLOSURE OF THE INVENTION

In one aspect, a sleeve metered pump includes a pump housing that defines a pump chamber, an inlet and an outlet. At least one plunger, which defines at least one vent, is positioned to reciprocate a stroke distance in the pump housing. A solenoid assembly includes a coil disposed around the plunger and a metering sleeve slideably mounted on the plunger. The metering sleeve has a position in which at least one vent is covered for a portion of the stroke distance.

In another aspect, a fuel injection system includes a plurality of fuel injectors fluidly connected to a common rail. A sleeve metered pump has an outlet fluidly connected to the common rail and an inlet fluidly connected to a source of fluid. The sleeve metered pump includes a solenoid assembly, and at least one plunger that defines a vent and is positioned to reciprocate a stroke distance in a pump housing. The solenoid assembly includes a coil disposed around at least one plunger and a metering sleeve slideably mounted on each plunger.

In still another aspect, a method of controlling output from a sleeve metered pump includes the initial step of providing a sleeve metered pump. A desired effective pumping stroke is determined for the sleeve metered pump. Next, a solenoid current magnitude is determined that corresponds to the desired effective pumping stroke. Finally, the position of the metering sleeve within the pump is adjusted by supplying current to its solenoid assembly at the level corresponding to the previously determined solenoid current magnitude.

BEST MODE FOR CARRYING OUT THE INVENTION

Figure 1:
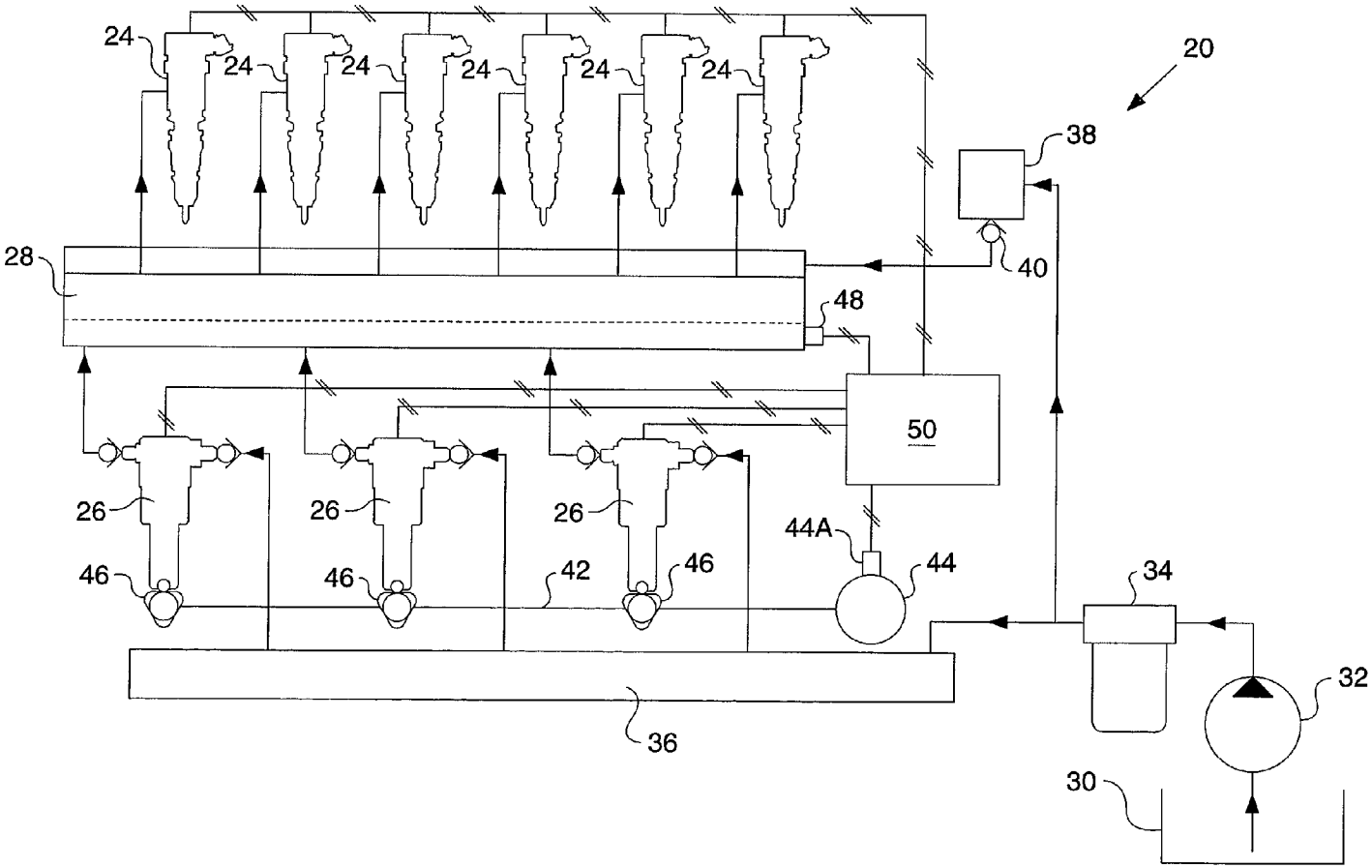
FIG. 1 is a diagrammatic representation of a common rail fuel injection system in accordance with this invention.

With reference to FIG. 1, a fuel injection system, generally designated 20 in accordance with this invention, for an internal combustion engine 22 (FIG. 2) comprises a plurality of unit injectors 24, which may be conventional but are preferably unit injectors having a nozzle check valve operable independent of injection pressure, such as the injectors described in commonly-owned U.S. Pat. Nos. 5,463,996, 5,669,335, 5,673,669, 5,687,693, 5,697,342, and 5,738,075. The preferred unit injectors are powered by pressurized engine oil, however those skilled in the art will recognize that this invention is equally applicable to common rail systems that use high pressure fuel to power the unit injector. Likewise, an intensified injector system is preferred, although this invention is also equally applicable to non-intensified injector systems.

The fuel system 20 further includes a plurality of variable delivery, reciprocating piston unit pumps 26, which supply high pressure fluid to a common high pressure fluid accumulator or rail 28. In the case where the injector actuation fluid is pressurized engine oil, oil is drawn from a sump or tank 30 in the engine 22 via an engine lube pump 32 and pumped through an oil filter 34 to the main engine oil gallery 36. Each unit pump 26 draws oil from a source of fluid, such as the engine oil gallery 36, and pumps high pressure oil to the common high pressure rail 28. In addition, oil from the sump 30 is also delivered to an elevated reservoir 38, which delivers fluid to the high pressure rail 28 via a check valve 40 for thermal make-up under low temperatures conditions. An associated camshaft 42 internal to the engine 22 drives each of the unit pumps 26, and the camshaft 42 is driven by the crankshaft 44 of the engine 22. The illustrated camshaft 42 have three lobes 46 at the location of each unit pump 26, but it will be recognized that the camshaft 42 may be provided with more or less than three lobes 46 as appropriate for the particular application. In the illustrated embodiment, each unit pump 26 will undergo three pumping strokes per revolution of the camshaft 42.

Pressure in the high pressure rail 28 is monitored by a conventional pressure sensor 48, which provides an electronic pressure signal to a suitable, conventional electronic control module (ECM) 50. Based on the sensed rail pressure and the desired rail pressure, the ECM 50 determines whether to raise or lower the pressure in rail 28, as the case may be. As will be described below, the pressure in the rail 28 is varied by varying the rate of delivery of fluid to the rail 28 from one or more of the unit pumps 26. In general, the delivery from each unit pump 26 is varied by adjusting the effective pumping stroke of the unit pump 26, which is the duration during each compression stroke thereof that fluid is pumped through the outlet of the unit pump 26 instead of back to the engine oil gallery 36 or the sump 30 as will be discussed below. The effective pumping stroke of each unit pump 26 is related to the angular or rotary position of the camshaft 42 at the beginning of the effective pumping stroke and thus the angular position of the crankshaft 44 at the beginning of the effective pumping stroke. The rotary position of the crankshaft 44 is provided to the ECM 50 via a conventional timing sensor 44A, and based on the required change in rail pressure, if any, determined by the ECM 50, the ECM 50 adjusts the effective pumping stroke of one or more of the unit pumps 26.

Figure 2:
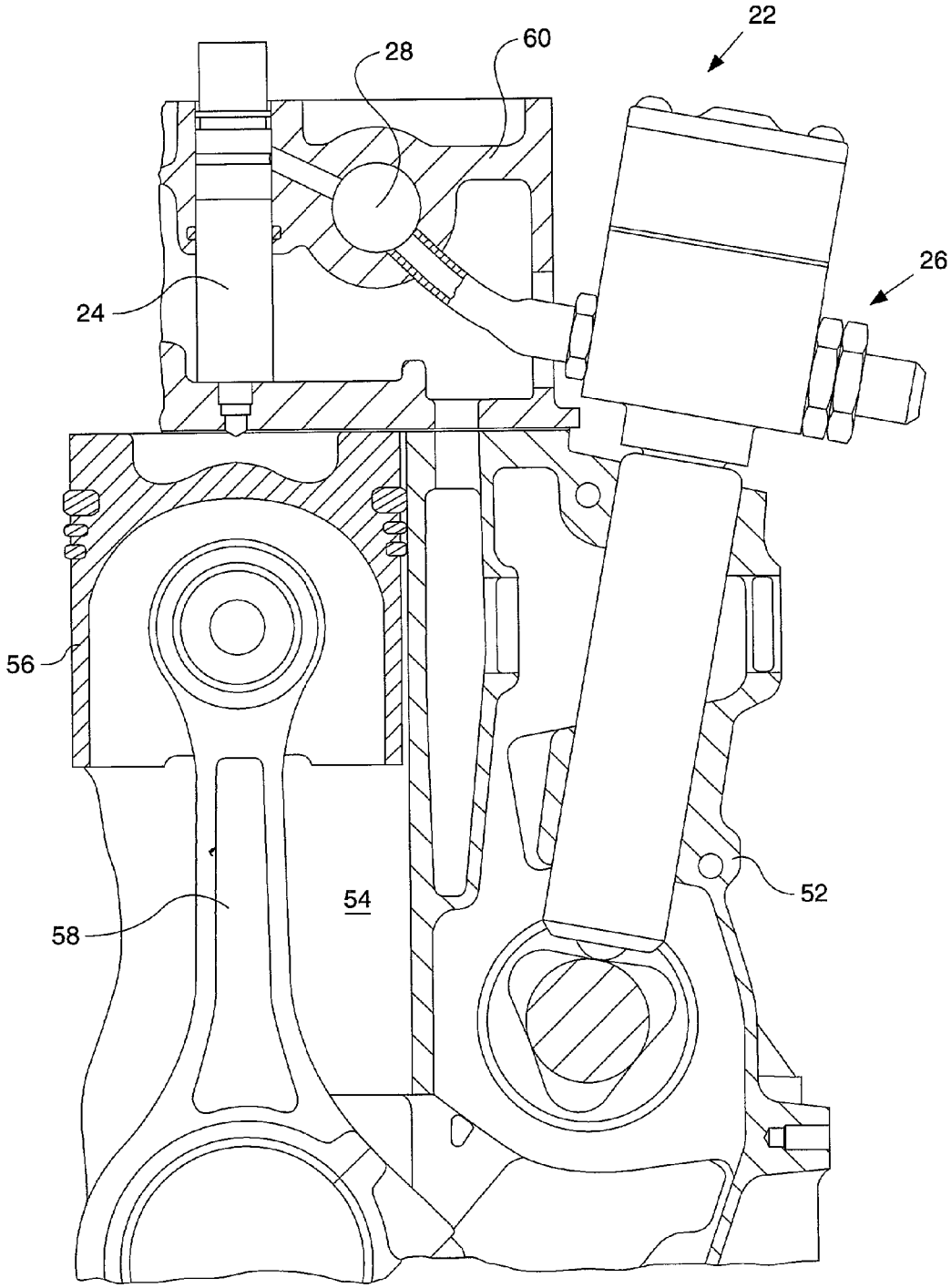
FIG. 2 is a fragmentary, cross-sectional view of a portion of an internal combustion engine utilizing one embodiment of variable delivery pump in accordance with this invention in connection with a common rail fuel system.

FIG. 2 illustrates a fragmentary portion of one cylinder of the internal combustion engine 22, which in this case is a diesel engine. One skilled in the art will recognize that various aspects of this invention may used with spark ignited engines if appropriate, as with gasoline direct injection for example. The engine 22, which may be conventional, includes a block 52 that defines one or more cylinders 54, only one of which is shown. A piston 56 reciprocates within the cylinder 52 and drives the crankshaft 44 via a connecting rod 58. The unit pump 26 is disposed within the block 52 and driven by the camshaft 42. FIG. 2 also illustrates one of the unit injectors 24 mounted in the head 60 of the engine 22, in which the high pressure fluid rail 28 is formed. Of course, one skilled in the art will recognize that the rail 28 may alternatively be a vessel separate from the head 60.

Figure 3:
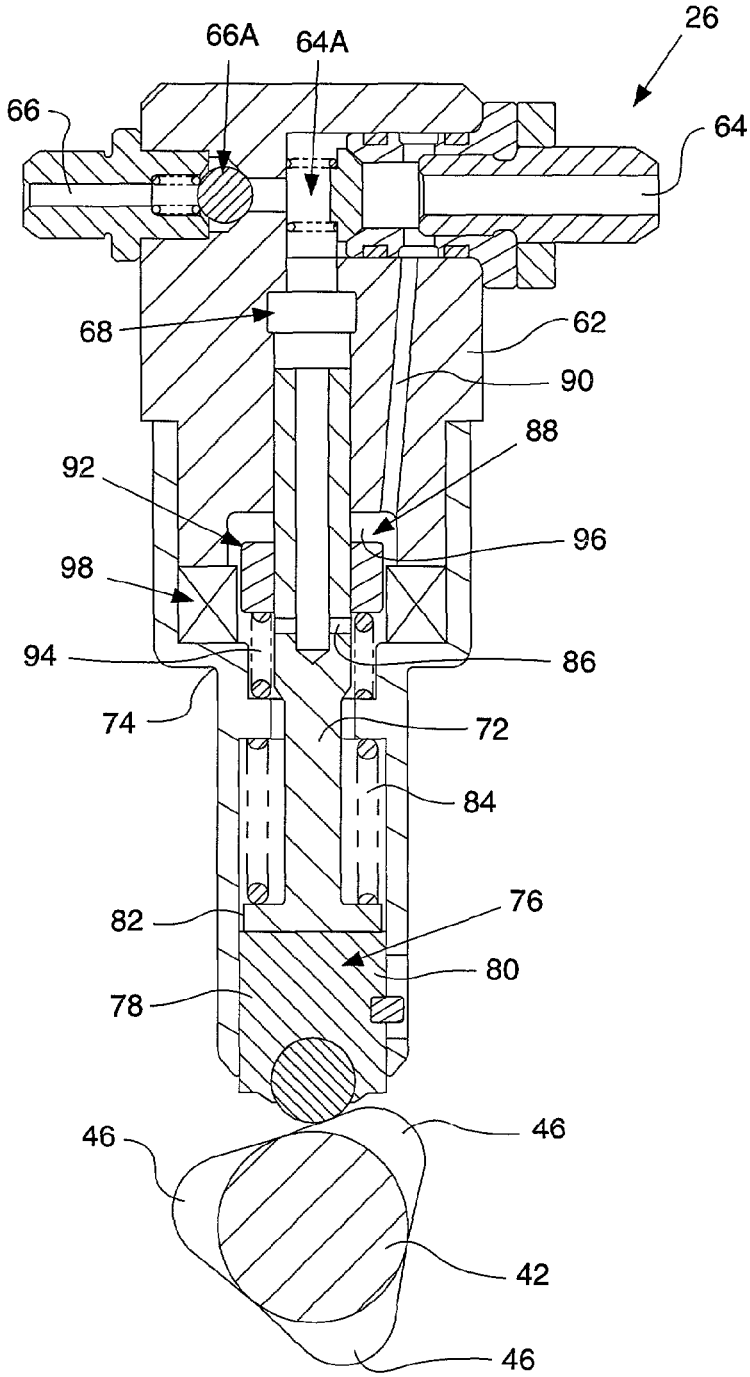
FIG. 3 is a cross-sectional view of the pump shown in FIG. 2.

FIG. 3 illustrates the unit pump 26 in greater detail. The unit pump 26 comprises a barrel 62 having an inlet 64 and an outlet 66 communicating with a pump chamber 68 formed within the barrel 62. The inlet is normally closed by a spring-biased check valve 64A and the outlet 66 is normally closed by a spring-biased check valve 66A. A hollow piston or plunger 72 is received within a portion of the pump chamber 68 and reciprocal therein. A follower guide 74 is attached to the barrel 62 concentric with the plunger 72, and a follower assembly, generally designated 76, is slidable within the follower guide 74. Together, barrel 62 and follower guide 74 can be thought of as a pump housing. The follower assembly 76 comprises a roller follower 78 rotatably mounted to a cylindrical guide block 80. While a roller follower is preferred, other suitable followers may also be used. The plunger 72 has a flange 82 at its lower end, which engages the guide block 80. A spring or other suitable bias member 84 is disposed between the flange 82 and a confronting surface of the follower guide 74 to bias the plunger 72 and guide block 80 downward. The roller follower 78 travels along the surface of the cam lobes 46 as the camshaft 42 rotates, causing the plunger 72 to be driven upwardly within the barrel 62 as the roller follower 78 travels along the upward slope of each lobe 46. As the roller follower 78 travels along the downward slope of a cam lobe 46, the spring 84 biases the roller follower 78 against the cam lobe 46 and the plunger 72 is drawn downwardly within the barrel 62.

With continued reference to FIG. 3, the plunger 72 is provided with at least one vent port 86 (two ports 86 are shown) that open to a fluid cavity 88 formed within the pump 26 around a portion of the plunger 72. The cavity 88 is connected with the inlet 64 of the pump 26 via a passageway 90 in the barrel 62. A metering sleeve 92 is slidably mounted concentrically with the plunger 72 and located within the cavity 88. The metering sleeve 92 is biased upwardly, as viewed in FIG. 3, by a bias spring 94 trapped between the sleeve 92 and an upwardly facing wall of the follower guide 74. A conventional solenoid coil 96 is disposed around the plunger 72 and the metering sleeve 92, as shown in FIG. 3. The metering sleeve 92 and the solenoid coil 96 together form a solenoid assembly 98, with the metering sleeve itself forming the armature of the solenoid assembly 98. In an alternative embodiment not shown in the drawing but evident from the preferred embodiment, the metering sleeve 92 may be a trapped between the spring 94 and an armature sleeve (not shown), in which case the metering sleeve itself is not the actual solenoid armature but does move together with the solenoid armature.

INDUSTRIAL APPLICABILITY

In operation, the downward stroke of the plunger 72 is the intake stroke of the unit pump 26, which draws fluid into the cavity 88 from the inlet 64 through the spring-biased inlet check valve 64A. Fluid is further drawn into the plunger 72 through the vent ports 86, which serve as inlets ports to the pump chamber 68. After completion of the intake stroke, the plunger 72 is driven upwardly through its compression or pumping stroke. Depending on the location of the metering sleeve 92 relative to the vent ports 86, the upward stroke of the plunger 72 causes fluid in the pump chamber 68 to be pumped either back out the vent ports 86 and into the cavity 88 or through the outlet check valve 66A to the outlet 66.

Because the metering sleeve 92 preferably forms the armature of the solenoid assembly 98 (or at least moves in unison with the armature), the position of the metering sleeve 92 depends on the current applied to the solenoid coil 96. If little or no current is applied to the solenoid coil 96, the metering sleeve will be pushed upwardly, as viewed in FIG. 3, until the spring 94 is uncompressed or the sleeve 92 engages the upper wall of the cavity 88. By applying current to the solenoid coil 96, the metering sleeve 92 can be driven downwardly relative to the plunger 72 against the force of the spring 94. The magnitude of the applied current determines how far the metering sleeve 92 is displaced from its unactivated, resting position. In other words, the position of the metering sleeve is preferably a function of the current supplied to the solenoid.

Minimum or zero fluid delivery from the unit pump 26 is achieved when no current is applied to the solenoid coil 96, in which case the sleeve 92 is positions such that the vent ports 86 remain uncovered during the entire plunger stroke. To increase the fluid delivery from the unit pump 26, a current corresponding to the desired output is applied to the solenoid coil 96, which drives the metering sleeve 92 downwardly. As a result, the vent ports 86 are covered and sealed by the metering sleeve 92 during a portion of the upward stroke of the plunger 72, and as a result, fluid is pumped from the pump chamber 68 through the outlet check valve 66A to the outlet 66 during that portion of the plunger stroke. By applying a higher current to the solenoid coil 96, the sleeve 92 can be driven further downward, which increases the duration during pumping stroke during in which the vent ports 86 are covered by the metering sleeve 92. As a result, the fluid delivery to the outlet 66 is increased, and maximum fluid delivery is achieved when the sleeve 92 is moved into contact with a stop surface on follower guide 74 to fully compress the spring 94. As apparent, a decrease in the fluid delivery to the outlet is achieved by applying a lower current to the solenoid coil 96.

This invention is illustrated with respect to a single plunger unit pump, but those skilled in the art will recognize that the principles of this invention are equally applicable in controlling fluid delivery from a pump having a plurality of reciprocal plungers. In such a pump, one or more of the plungers would be provided with a metering sleeve that forms the armature of a solenoid assembly. Examples of piston/plunger pumps in which this invention may be applied include both radial piston pumps and axial piston pumps.

Although the presently preferred embodiments of this invention have been described, it will be understood that within the purview of the invention various changes may be made within the scope of the following claims.

The invention claimed is:

1. A fuel injection system comprising:

a common rail;

a plurality of fuel injectors fluidly connected to said common rail;

a source of fluid;

a sleeve metered pump with an outlet fluidly connected to said common rail and an inlet fluidly connected to said source of fluid;

an inlet check valve fluidly positioned between said source of fluid and a pump chamber of said sleeve metered pump;

said sleeve metered pump including a solenoid assembly, at least one plunger that defines a vent and is positioned to reciprocate a stroke distance in a pump housing;

said solenoid assembly includes a coil disposed around said at least one plunger and a metering sleeve slidably mounted on each said at least one plunger; and a camshaft operably coupled to said pump and being rotatable with respect to said at least one plunger.

2. The fuel injection system of claim 1 wherein a position of said metering sleeve is a function of current supplied to said solenoid assembly.

3. The fuel injection system of claim 1 wherein said metering sleeve has a first position in which said at least one vent is uncovered throughout said stroke distance; and said metering sleeve has a second position in which said at least one vent is covered throughout said stroke distance.

4. The fuel injection system of claim 3 including a spring operably positioned in said pump housing to bias said metering sleeve toward said first position.

5. The fuel injection system of claim 1 wherein said solenoid assembly includes an armature; and said armature is either a portion of said metering sleeve or operably positioned to move with said metering sleeve.

6. The fuel injection system of claim 1 wherein said at least one plunger is a single plunger.

7. The fuel injection system of claim 1 wherein said position of said metering sleeve is a function of current supplied to said solenoid assembly;

said metering sleeve has a first position in which said at least one vent is uncovered throughout said stroke distance, and a second position in which said at least one vent is covered throughout said stroke distance;

a spring operably positioned in said pump housing to bias said metering sleeve toward said first position;

said solenoid assembly includes an armature that is a portion of said metering sleeve;

said at least one plunger is a single plunger.

8. A method of controlling output from a sleeve metered pump in a common rail fuel injection system, comprising the steps of:

providing a sleeve metered pump that includes at least one plunger positioned to reciprocate a stroke distance in a pump housing and defining at least one vent, and further includes a solenoid assembly with a coil disposed around said at least one plunger and a metering sleeve slidably mounted on each said at least one plunger;

determining a desired effective pumping stroke for said sleeve metered pump;

determining a solenoid current magnitude that corresponds to said desired effective pumping stroke;

adjusting a position of said metering sleeve by supplying current to said solenoid assembly at a level corresponding to said solenoid current magnitude;

pumping fluid at least in part by rotating a camshaft, which is operably coupled to said sleeve metered pump, with respect to said at least one plunger; and refilling a pump chamber at least in part by opening an inlet check valve fluidly positioned between the pump chamber and a source of fluid.

9. The method of claim 8 wherein said adjusting step is accomplished by applying a magnetic force to said metering sleeve via said coil.

10. The method of claim 8 wherein, if said desired effective pumping stroke is determined to be zero, then setting said solenoid current magnitude to zero.

11. The method of claim 8 wherein, if said desired effective pumping stroke corresponds to a maximum fluid delivery, then said adjusting step includes supplying a current that is sufficient to move said metering sleeve into contact with a stop surface.

12. The method of claim 8 wherein said determining steps are accomplished with an electronic control module.

* * * * *